United States Patent [19]

Righetti

[11] 4,437,268

[45] Mar. 20, 1984

[54] BEVELING APPARATUS

[75] Inventor: Gaetano Righetti, Pesaro, Italy

[73] Assignee: Hoyne Industries, Inc., Rolling Meadows, Ill.

[21] Appl. No.: 428,108

[22] Filed: Sep. 29, 1982

Related U.S. Application Data

[62] Division of Ser. No. 167,207, Jul. 9, 1980, Pat. No. 4,375,141.

[51] Int. Cl.[3] ..... B24B 1/00

[52] U.S. Cl. ..... 51/327

[58] Field of Search ..... 51/3, 80 A, 101 R, 283 R, 51/283 E, 76 R, 327

[56] References Cited

U.S. PATENT DOCUMENTS

| | | | |
|---|---|---|---|
| 1,950,758 | 3/1934 | Sommer | 51/34 A |
| 2,170,687 | 8/1939 | Johnson | 51/80 A |
| 3,274,736 | 9/1966 | Brokaw | 51/101 R |

FOREIGN PATENT DOCUMENTS

| | | | |
|---|---|---|---|
| 4612508 | 10/1966 | Japan | 51/80 A |

*Primary Examiner*—Harold D. Whitehead
*Attorney, Agent, or Firm*—Kirkland & Ellis

[57] ABSTRACT

Apparatus for quickly and efficiently beveling the edges of a workpiece such as a sheet of glass having at least two pairs of parallel sides, generally a square, without manual intervention during the process. The workpiece is positioned on a conveyor with the first pair of parallel sides parallel to the direction in which the conveyor moves the workpiece. Guides are provided for maintaining the angular orientation of the workpiece. The workpiece is conveyed sequentially through: a first grinding apparatus which grinds the first pair of parallel edges; a first turntable which rotates the workpiece through a precisely controlled angle to position the second pair of sides parallel to the direction of transport; a second grinding apparatus which grinds the second pair of parallel edges; a first polishing station which polishes the second pair of edges; a second turntable which rotates the workpiece through a precisely controlled angle so that the first pair of edges is again parallel to the direction of transport; and a second polishing station which polishes the first pair of edges. Coolants, lubricants, and polish are sprayed on the workpiece as necessary. The position of the grinders and polishers with respect to the conveyor are adjustable such that the angle and depth at which the workpiece edges are ground and polished can be selected. In addition, these adjustments permit compensation for wear of the grinding wheels and polishing wheels. The polishers further include ammeters connected to their motors which indirectly measure the pressure exerted on the workpiece by the polishing wheel. The turntables are pneumatically operated so as to lift the workpiece from the conveyor, rotate the workpiece through a precisely controllable angle, and return the workpiece to the conveyor in a short period of time. Other configurations of grinders, polishers, and turntables are also contemplated.

4 Claims, 8 Drawing Figures

10
30
31
32
35
50
70
71
72
75
90
91
92
95
110
130
131
132
135
3
b b
31
50
71
91
110
131

A
20
92
93
94
95
96
97
98
99
101
102
103

162
175
176
157
177
155
173
171
174
172

BEVELING APPARATUS

This is a division of application Ser. No. 167,207, filed July 9, 1980 and now U.S. Pat. No. 4,375,141, issued Mar. 1, 1983.

BACKGROUND OF THE INVENTION

1. Field of the Invention

The subject invention pertains to the art of glass grinding, and is particularly suited for beveling the edges of a square glass workpiece such as a mirror.

2. Description of the Prior Art

A variety of glass beveling machines is known in the art. Some glass beveling machines include a series of grinders and a series of polishers positioned along a single conveyor such that a single edge of the workpiece can be ground and polished in one pass through the device. More efficient prior art machines provide two sets of grinders and polishers disposed on either side of the conveyor such that two opposite parallel edges can be ground and polished in a single pass through the device.

In prior art systems, it is necessary to reposition the workpiece manually. Of course proper alignment of the workpiece for the grinding and polishing operations is essential. Failure to align a workpiece properly will cause it to jam, and probably shatter. Succeeding workpieces are also likely to jam and break until the conveyor can be cleared, leading to substantial reductions in yield. Because of variations in the amount of time necessary to accomplish this repositioning, substantial time intervals (i.e. substantial space on the moving conveyor) have to be allowed between successive workpieces in order to avoid the interference which will result if one workpiece cannot be satisfactorily repositioned before the succeeding workpiece arrives at the work station in question. Thus, prior art systems require excessive gaps between successive workpieces and suffer from a commensurate reduction in output capacity for a given apparatus.

BRIEF SUMMARY OF THE INVENTION

The subject invention is a method for automatically grinding the edges of a workpiece having at least two pairs of parallel sides, as for example to provide a beveled edge along the perimeter of a planar rectangular sheet of glass. The workpiece is repositioned automatically throughout the process, as necessary. The subject invention is equally suited for use in conjunction with glass having a mirrored finish, or other decorative or utilitarian features. The workpiece is positioned on a conveyor which transports the workpiece in a substantially linear direction through a first work station means for grinding disposed on either side of the conveyor and positioned so that the desired bevel is ground into the first pair of parallel edges. A first means for rotating then repositions the workpiece such that a second pair of parallel edges is positioned precisely parallel to the direction in which the workpiece is transported. This second pair of parallel edges is then ground by a second work station means for grinding disposed on either side of the conveyor. The conveyor then transports the workpiece past a third work station means for polishing disposed on either side of the conveyor and positioned so as to polish the second pair of parallel edges of the workpiece. A second means for rotating then repositions the workpiece so that the first pair of parallel edges is again precisely parallel to the direction in which the workpiece is transported. This first pair of edges is then polished at a fourth work station means for polishing whereby the four edges of a rectangular glass workpiece are ground and polished to form a beveled edge without any need for manual repositioning. Other configurations of the present invention would be particularly suited to the beveling of square workpices or workpieces having the shape of other polygons having pairs of parallel edges.

As hereinafter described, in the preferred embodiment of the present invention, the turntable is pneumatically controlled so as to provide quick and precise repositioning, thereby allowing successive workpieces to be processed by the apparatus with a minimum interval between successive workpieces. Guide rollers maintain the angular position of the workpiece as it moves along the conveyor. Each grinding and polishing operation is performed by a series of grinding or polishing wheels positioned along the conveyor. Coolants, lubricants, and polish are sprayed on the workpiece as appropriate. The grinding and polishing wheels are mounted so as to permit adjustment for workpieces of different sizes and different bevel angles. An ammeter connected to the polisher motors permits precise control of the pressure exerted on the workpiece by each polishing wheel. A variety of other grinder-polisher-turntable configurations is also contemplated by the present invention.

It is the principal object of the present invention to provide a method for beveling the edges of a glass workpiece having at least two pairs of parallel edges in a single pass through the apparatus, without the need for manual repositioning of the workpiece from the time the unbeveled workpiece is loaded into the apparatus until the edges have been beveled.

It is an additional object of the present invention to accomplish this result through the use of a pneumatically controlled turntable which can remove the workpiece from a moving conveyor, reposition it by rotating it through a precisely determined angle, and return the workpiece to the conveyor. In this manner, the workpiece can be automatically and rapidly repositioned without interfering with other workpieces which are in process on the apparatus.

It is a further object of the present invention to provide automatic means for repositioning the workpiece between successive operations which can accomplish the repositioning within a well-determined period of time such that more than one workpiece can be in process on the apparatus simultaneously, without substantial risk that adjacent workpieces would interfere with one another.

These and other objects and advantages and features of the present invention are hereinafter set forth, and for purposes of illustration but not limitation, certain preferred embodiments of the present invention are hereinafter described and illustrated in the accompanying drawings.

DETAILED DESCRIPTION OF THE PREFERRED EMBODIMENT

Figure 1:
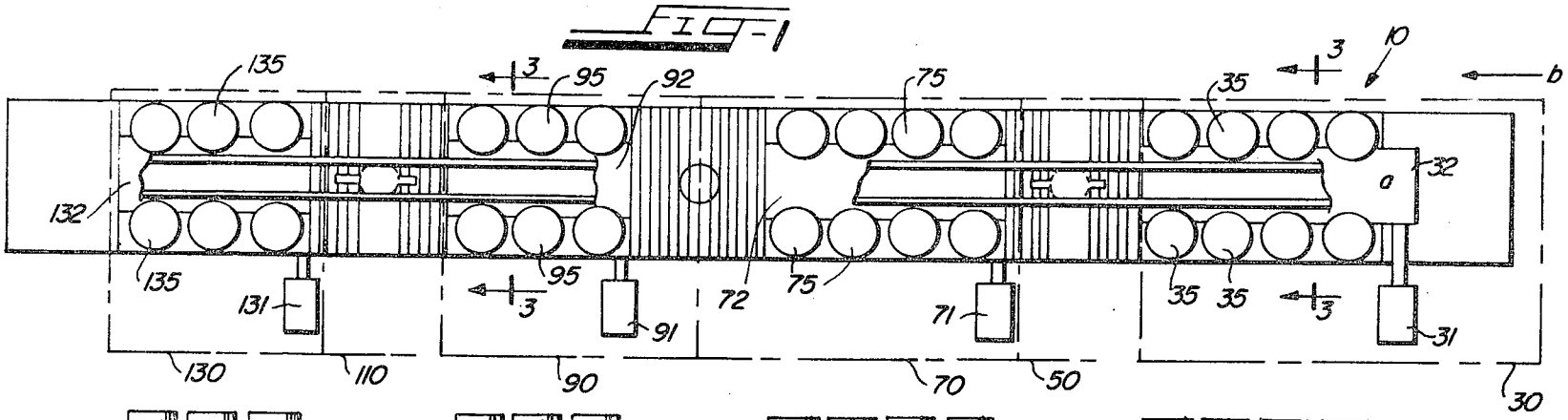
FIG. 1 is an overhead schematic view of an apparatus in accordance with the present invention showing the grinding stations, the polishing stations and the turntables.
Figure 2:
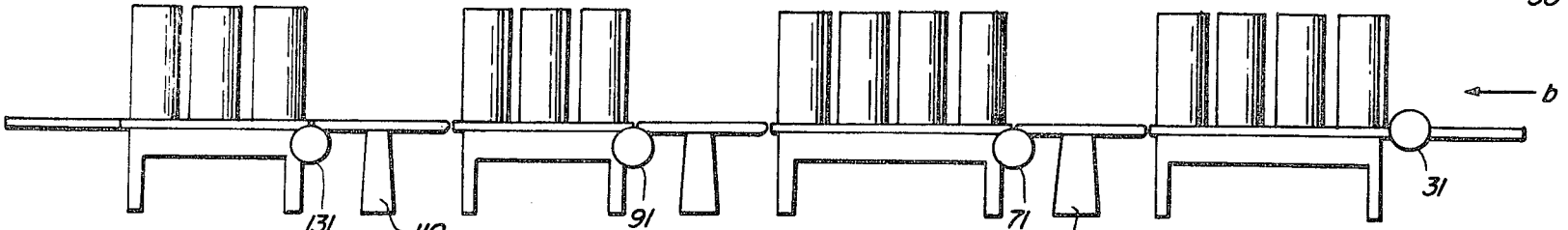
FIG. 2 is a side schematic view of an apparatus in accordance with the present invention.
Figure 3:
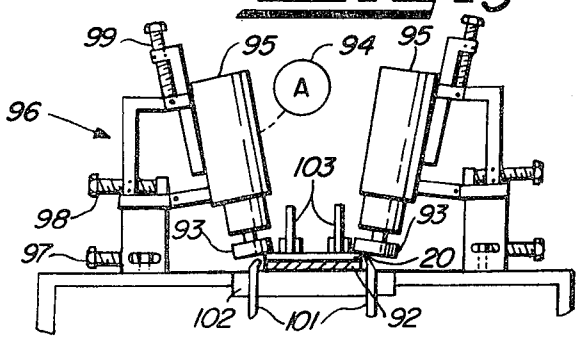
FIG. 3 is a sectional end view taking substantially along the line 3—3 in FIG. 1 showing a typical polisher, including the apparatus for positioning the polisher, and showing the position of the polishing wheel with respect to the workpiece.
Figure 4:
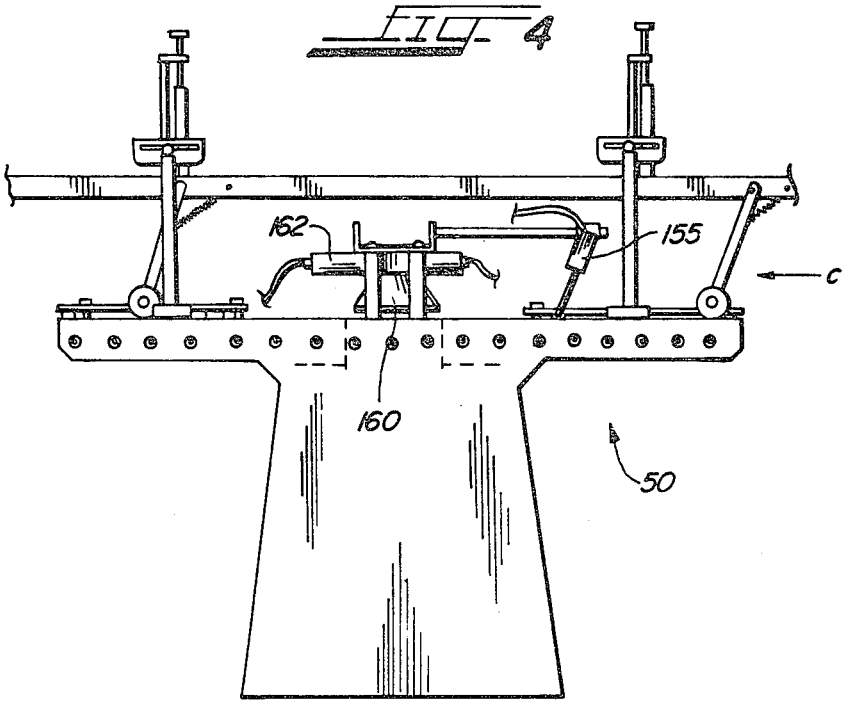
FIG. 4 is a detailed side view of a turntable in accordance with the present invention.
Figure 5:
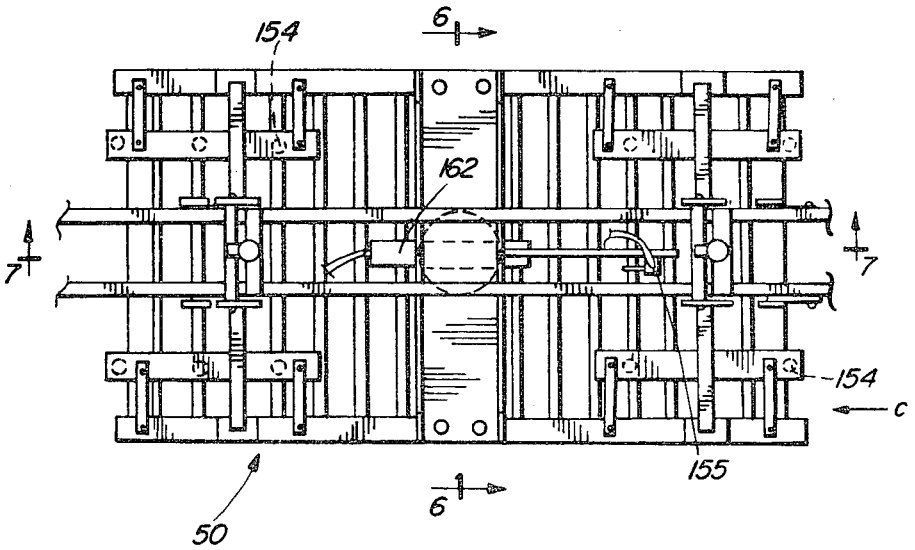
FIG. 5 is an detailed overhead view of a turntable in accordance with the present invention.

Referring to FIGS. 1, 2, and 3, first grinding station 30 includes a drive motor 31 for driving conveyor 32. The structure of the drive motor 31 and the conveyor 32 are conventional, and known to those skilled in the art. The workpiece 20 is inserted into the beveling apparatus 10 at position "a," and is carried by conveyor 32 past grinders 35 in the direction of arrow "b." Grinders 35 bevel the first pair of parallel edges of the workpiece to a rough beveled finish. Conveyor 32 transports the workpiece to first turntable 50 which rotates the workpiece through an angle of 90 degrees about a vertical axis through its center. The operation of the turntable is described in greater detail below in connection with FIGS. 4–7. Turntable 50 transports the workpiece to second grinding station 70 which includes a drive motor 71 for driving conveyor 72. Conveyor 72 carries the workpiece past grinders 75 which grind the second pair of parallel sides of the workpiece to a rough beveled edge. Conveyor 72 then transports the workpiece to first polishing station 90. First polishing station 90 includes a drive motor 91 which drives conveyor 92. Conveyor 92 carries the workpiece past polishers 95 which polish the rough ground bevel on the second pair of parallel edges to a smooth finish. Conveyor 92 then transports the workpiece to second turntable 110 (which is substantially identical to first turntable 50) which rotates the workpiece through an angle of 90 degrees about a vertical axis through its center. Conveyor 112 then transports the workpiece to second grinding station 130 which includes drive motor 131 for driving conveyor 132. Conveyor 132 carries the workpiece past polishers 135 which polish the first pair of parallel edges of the workpiece to a smooth finish. Processing of the workpiece is then completed.

Referring to FIG. 3, a typical polisher 95 is shown in detail. Each of the polishers 95 is mounted on an adjustable support 96. The polisher can be set for workpieces of various widths using adjusting screw 97. The angle of the polishing wheel 93 with respect to the workpiece 20 can be controlled by adjusting screw 98; and the height of the polishing wheel 93 can be controlled by adjusting screw 99. Polisher 95 uses a conventional electric motor (not shown). The pressure exerted by the polishing wheel 93 on the workpiece 20 can be gauged by measuring the current drawn by the polisher motor. Accordingly, in the preferred embodiment of the present invention, an ammeter 94 is connected to each of the polishers 95 to provide for convenient adjustment of the pressure exerted by the polishing wheel 93 to compensate for wear of the polishing wheel 93. Nozzles 101 spray polishing fluid at the surface being polished. This serves the additional function of providing cooling necessary to keep the polishing wheel and the workpiece from overheating. Catch basins (not shown) can be positioned beneath the polisher to catch the fluid so that it can be recycled. Hold-down rollers 103 help to hold the workpiece firmly in position against the conveyor 92. Support rollers 102 are disposed beneath conveyor 92 at sufficiently small intervals to prevent conveyor 92 from sagging. Polishers 135 are substantially indentical to polishers 95.

Each of the grinders 35 and 75 is substantially identical in configuration to the polisher assembly shown in FIG. 3, except that an ammeter is not useful as a means of gauging the pressure exerted by the grinding wheels against the workpiece, and accordingly ammeters are not used with the grinders. Instead, a micrometer caliper can be incorporated into adjusting screw 99. All of the polishing wheels are composed of compressed cotton fiber. The grinding wheels are composed of a progressively finer grain abrasive in each of the four successive grinders associated with each side of grinding station 30 and grinding station 70. In the preferred embodiment of the present invention, the first grinding wheel in each grinding station 30, 70 has a grinding surface composed of coarse diamond, followed by a fine diamond wheel, a coarse composition wheel, and fine composition wheel. It should also be noted that the fluid sprayed on the grinding wheel is a combination coolant and lubricant, rather than the polishing liquid used in conjunction with polishers 95 and 135.

Figure 6:
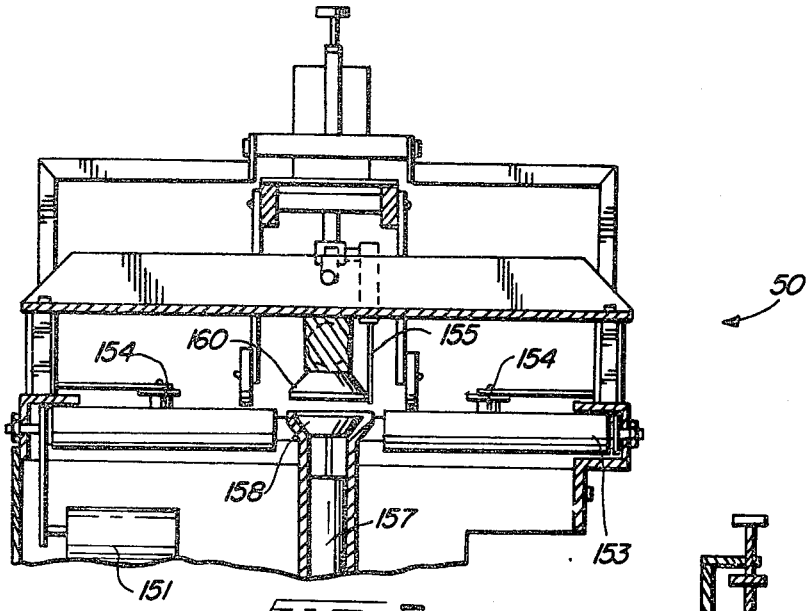
FIG. 6 is a sectional view of the turntable in accordance with the present invention taken substantially along the line 6—6 in FIG. 5.
Figure 7:
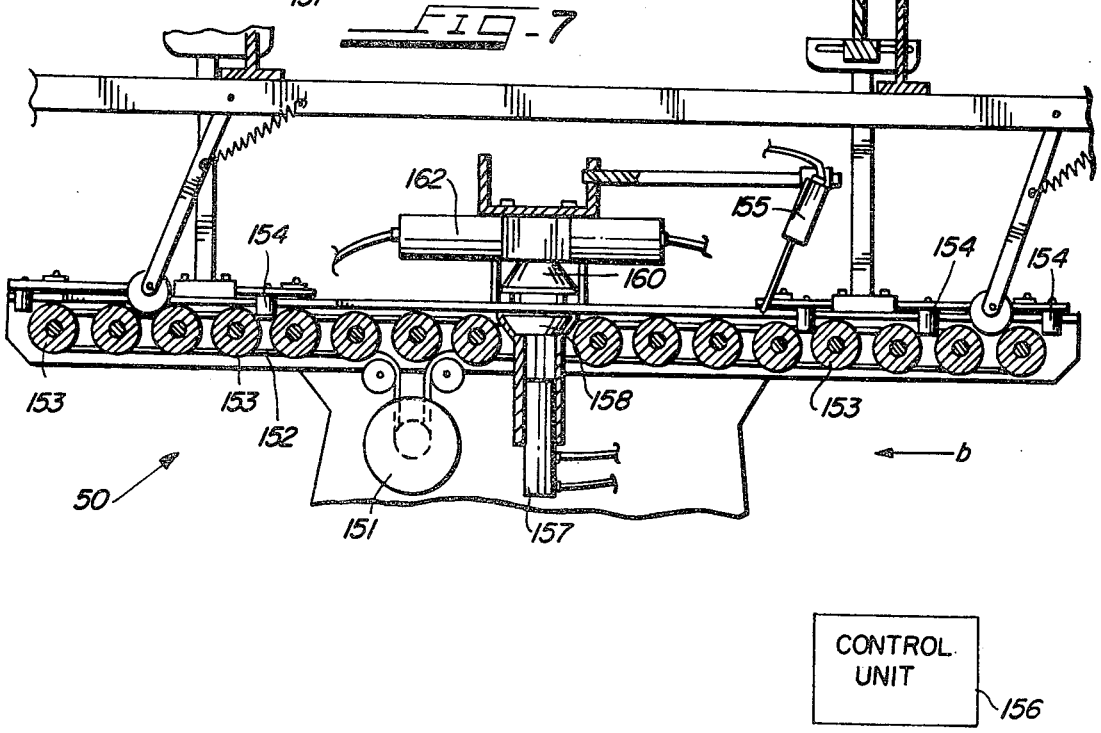
FIG. 7 is a sectional detailed view of a turntable in accordance with the present invention taken substantially along the line 7—7 in FIG. 5.

Referring to FIGS. 4–7, turntable 50 is shown in detail. It should be noted that turntable 110 is substantially identical to turntable 50. The direction in which the workpiece is transported is indicated by arrow "c." Drive motor 151 drives belt 152 which in turn drives the rollers 153 which carry the workpiece through turntable 50. As can be seen in FIGS. 6 and 7, turntable 50 includes two opposing rows of guide rollers 154 which keep the workpiece from turning except when it is in position over the center of turntable 50. It should be noted that these guide rollers are also utilized within grinding stations 30 and 70, and polishing stations 90 and 130 to keep the workpiece straight as it is being ground and polished. A switch 155 is positioned to intercept the path taken by the workpiece. When switch 155 is triggered, it signals control unit 156 to commence timing the interval necessary for the workpiece (not shown) to become centered directly over lifting pad 158. When the control unit 156 determines that the workpiece is in position, it triggers lifting piston 157, and lifting pad 158 picks the workpiece up off of rollers 153 and brings the upper surface of the workpiece into contact with rotation pad 160. When lifting piston 157 reaches its full extension so that the workpiece is firmly in contact with rotation pad 160 the control unit 156 causes double acting rotation piston 162 to rotate rotation pad 160 though an angle of precisely 90 degrees. The lifting pad 158 of lifting piston 157 is free to rotate. Therefore, when rotation pad 160 is rotated through the 90 degree angle, the workpiece rotates with it. When rotation piston 162 has rotated the workpiece through the specified angle, control unit 156 causes lifting piston 157 to lower the workpiece back into contact with rollers 153 whereupon it resumes its movement along the rollers. Control unit 156 then returns double acting rotation piston 162 to its "ready" position by pressurizing the return side of the double acting rotation piston 162.

Figure 8:
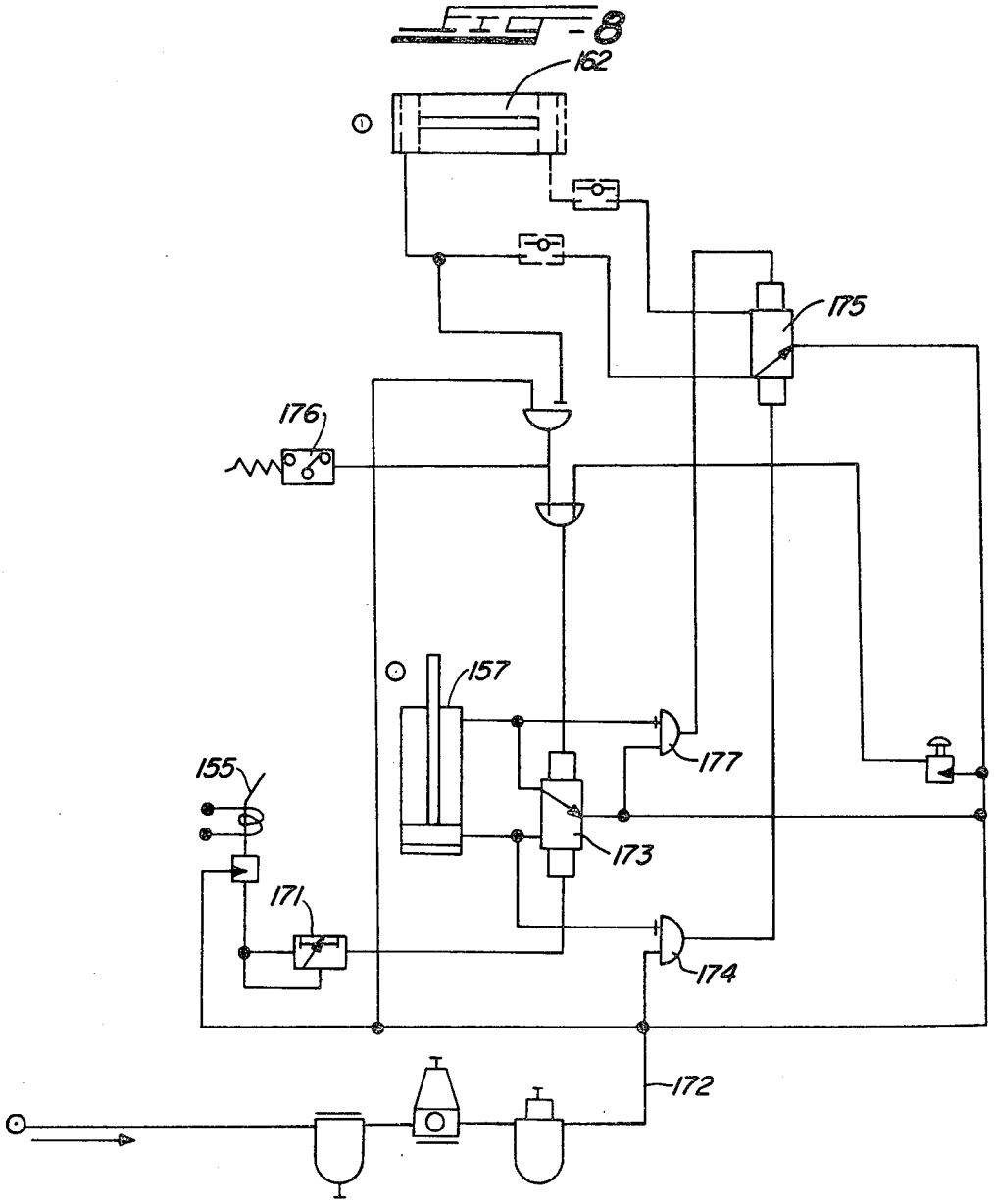
FIG. 8 is a circuit diagram for the pneumatic control circuit of the present invention.

A detailed diagram of the pneumatic control circuit appears in FIG. 8. Compressed air is provided on line 172. When switch 155 is triggered by the workpiece, compressed air is passed to timer 171. Upon expiration of a preset time interval (i.e., when the workpiece is centered over the lifting pad 158) timer 171 signals setting valve 173 to provide air to lifting piston 157 thereby raising the workpiece. When the workpiece is raised, lift control valve 174 is triggered thereby causing the setting valve 175 to provide air to double acting rotation piston 162 thereby rotating the workpiece. When the rotation of the workpiece has been completed, timer valve 176 causes the setting valve 173 to release lifting piston 157 thereby lowering the workpiece to the conveyor. When lifting piston 157 has been lowered, control valve 177 causes setting valve 175 of double acting rotation piston 162 to reset the double acting rotation piston 162 to its ready position.

Because the operation of turntables 50 and 110 is automatic, and under precise control, the amount of time needed to reposition the workpiece is fixed. Accordingly, the interval on the conveyor which is necessary to permit a workpiece to be rotated and returned to the conveyor before the arrival of the next workpiece is also fixed. Thus, the present invention permits workpieces to be placed in the closest possible succession on the conveyor without interfering with the repositioning operation. This permits the output of a given set of grinders and polishers to be optimized.

It is readily apparent that other configurations of grinders, polishers, and turntables are within the scope of the present invention. For instance, if only square workpieces are to be processed, the second turntable could be eliminated by grinding and polishing the first pair of sides, turning the workpiece, and then grinding and polishing the second pair of sides. The configuration described in the detailed description provides additional flexibility since it can process rectangular workpieces provided that the first grinding station and the second polishing station are both set to one dimension of the workpiece, and the second grinding station and the first polishing station are set to the other dimension of the workpiece. It is also apparent that workpieces which are not four-sided can be processed with the subject invention. For instance, workpieces in the shape of a regular hexagon could be processed using three sets of polishers and grinders separated by two turntables provided that the turntables are adjusted to rotate the workpiece through a 60 degree angle instead of a 90 degree angle. Through the appropriate selection and configuration of grinders, polishers, and turntables, any polygon having parallel opposite sides can be beveled using variations on the subject invention.

The foregoing description of certain preferred embodiments of the present invention has been set forth only as an example, and not limitation; the scope of the subject invention being defined solely by the following claims.

We claim:

1. A method for grinding the edges of a workpiece having at least two pairs of parallel sides comprising:

conveying the workpiece through a series of sequential work stations;

grinding the edges of a first pair of parallel sides of the workpiece positioned parallel to the direction in which the workpiece is transported as the workpiece is conveyed through a work station;

lifting the workpiece from the means for conveying, rotating the workpiece to a position a second pair of parallel sides in a direction parallel to the direction in which the workpiece is transported, and lowering the workpiece back down to the means for conveying;

grinding the edges of the second pair of parallel sides of the workpiece positioned parallel to the direction in which the workpiece is transported as the workpiece is conveyed through a work station;

polishing the edges of the second pair of parallel sides of the workpiece as it passes through a work station;

lifting the workpiece from the means for conveying, rotating the workpiece to position the first pair of parallel sides in a direction parallel to the direction in which the workpiece is transported, and lowering the workpiece back down to the means for conveying; and polishing the edges of the first pair of parallel sides of the workpiece as it passes through a work station.

2. A method for grinding the edges of a workpiece having at least two pairs of parallel sides comprising:

conveying the workpiece through a series of sequential work stations;

grinding the edges of a first pair of parallel sides of the workpiece positioned parallel to the direction in which the workpiece is transported through a work station;

lifting the workpiece from the means for conveying, rotating the workpiece to position a second pair of parallel sides in a direction parallel to the direction in which the workpiece is transported, and lowering the workpiece back down to the means for conveying;

grinding the edges of the second pair of parallel sides of the workpiece positioned parallel to the direction in which the workpiece is transported through a work station;

lifting the workpiece from the means for conveying, rotating the workpiece to position the first pair of parallel sides in a direction parallel to the direction in which the workpiece is transported, and lowering the workpiece back down to the means for conveying through a work station;

polishing the edges of the first pair of parallel sides;

lifting the workpiece from the means for conveying, rotating the workpiece to position the second pair of parallel sides in a direction parallel to the direction in which the workpiece is transported, and lowering the workpiece back down to the means for conveying; and polishing the edges of the second pair of parallel sides through a work station.

3. A method for grinding the edges of a workpiece having at least two pairs of parallel sides comprising:

conveying the workpiece through a series of sequential work stations;

grinding and polishing the edges of a first pair of parallel sides of the workpiece positioned parallel to the direction in which the workpiece is transported as the workpiece is conveyed through a work station;

lifting the workpiece from the means for conveying, rotating the workpiece to position a second pair of parallel sides in a direction parallel to the direction in which the workpiece is transported, and lowering the workpiece back down to the means for conveying; and grinding and polishing the edges of the second pair of parallel sides of the workpiece positioned parallel to the direction in which the workpiece is transported as the workpiece is conveyed through a work station.

4. The method of any one of claims 1, 2 or 3 where lifting, rotation and lowering of the workpiece is accomplished via a turntable.

* * * * *